United States Patent [19]

Fatula, Sr. et al.

[11] Patent Number: 4,499,693

[45] Date of Patent: Feb. 19, 1985

[54] METHOD OF GRINDING NON-UNIFORM WORKPIECES

[75] Inventors: James J. Fatula, Sr., Ellwood City, Pa.; Martin J. Carroll, Sun City Center, Fla.

[73] Assignee: Ryman Engineering Company, Ellwood City, Pa.

[21] Appl. No.: 418,440

[22] Filed: Sep. 15, 1982

[51] Int. Cl.[3] ..... E05D 17/00

[52] U.S. Cl. ..... 51/322; 51/145 R; 51/165.73

[58] Field of Search ..... 51/145 R, 165.73, 322

[56] References Cited

U.S. PATENT DOCUMENTS 2,332,329 10/1943 Maca ..... 51/145 R
2,449,387 9/1948 Johnson ..... 51/145 R
3,095,674 7/1963 Lee ..... 51/145 R
3,760,537 9/1973 Borati ..... 51/145 R

FOREIGN PATENT DOCUMENTS 91458 4/1897 Fed. Rep. of Germany .... 51/145 R

*Primary Examiner*—James L. Jones, Jr.
*Attorney, Agent, or Firm*—Martin J. Carroll

[57] ABSTRACT

In grinding non-uniform workpieces rotating about a longitudinal axis an endless abrasive belt passes over a contact roll in tangent contact. The rotating workpiece is pressed against the belt at the tangent point and the belt is passed around the workpiece on at least one side from the contact point. The amount of wrap is sufficient to heat the workpiece relatively uniform. Either plunge or traverse grinding may be used.

6 Claims, 2 Drawing Figures

METHOD OF GRINDING NON-UNIFORM WORKPIECES

This invention relates to a method of grinding non-uniform workpieces and more particular to belt grinding of such workpieces rotating about a longitudinal axis. A non-uniform workpiece is one in which more heat is produced in normal grinding in one area of the workpiece than another. Examples of such workpieces are tubular products having variations in wall thicknesses or in which the outer and inner surfaces are not co-axial, tapered objects, and objects having a rough outer surface so that the belt has irregular contact along its length. Such objects are normally ground by means of a belt-grinder or abrasive wheel with the rotating abrasive member contacting the workpiece at a line or broken line along its length. In the case of a belt grinder this contact is between the points of tangency of the belt on the work roll. Due to the unequal heat produced in different areas during the grinding operation the workpiece becomes contoured and normally this condition tends to worsen as the grinding continues. For example, only high spots will be ground in early stages of grinding certain types of workpieces so that there is localized heat input along its length.

In order to remedy this condition the feeding speed of the workpiece has been lowered to enable the heat to spread by conduction, but this has been only partially successful. In addition, it is costly because of the time involved. Also, water has been added in an attempt to equalize the heat by cooling the workpiece. This also is only partially successful. At the best the finished workpiece only meets the lower standards and at the worse the workpiece is often scrapped.

We have found that by going contrary to the previous practice, and adding heat in the grinding operation, much better results are obtained. The results are even better and the operation less expensive by also increasing the normal speed of feed of the workpiece. For example, one particular workpiece which required 45 minutes to grind can be ground in one minute and also results in a better product. It is also possible to lower the belt tension, thus decreasing the power requirement.

It is therefore an object of our invention to provide a method of belt grinding non-uniform workpieces at a faster rate and to produce a better product.

This and other objects will be more apparent after referring to the following specification and attached drawings in which.

Figure 1:
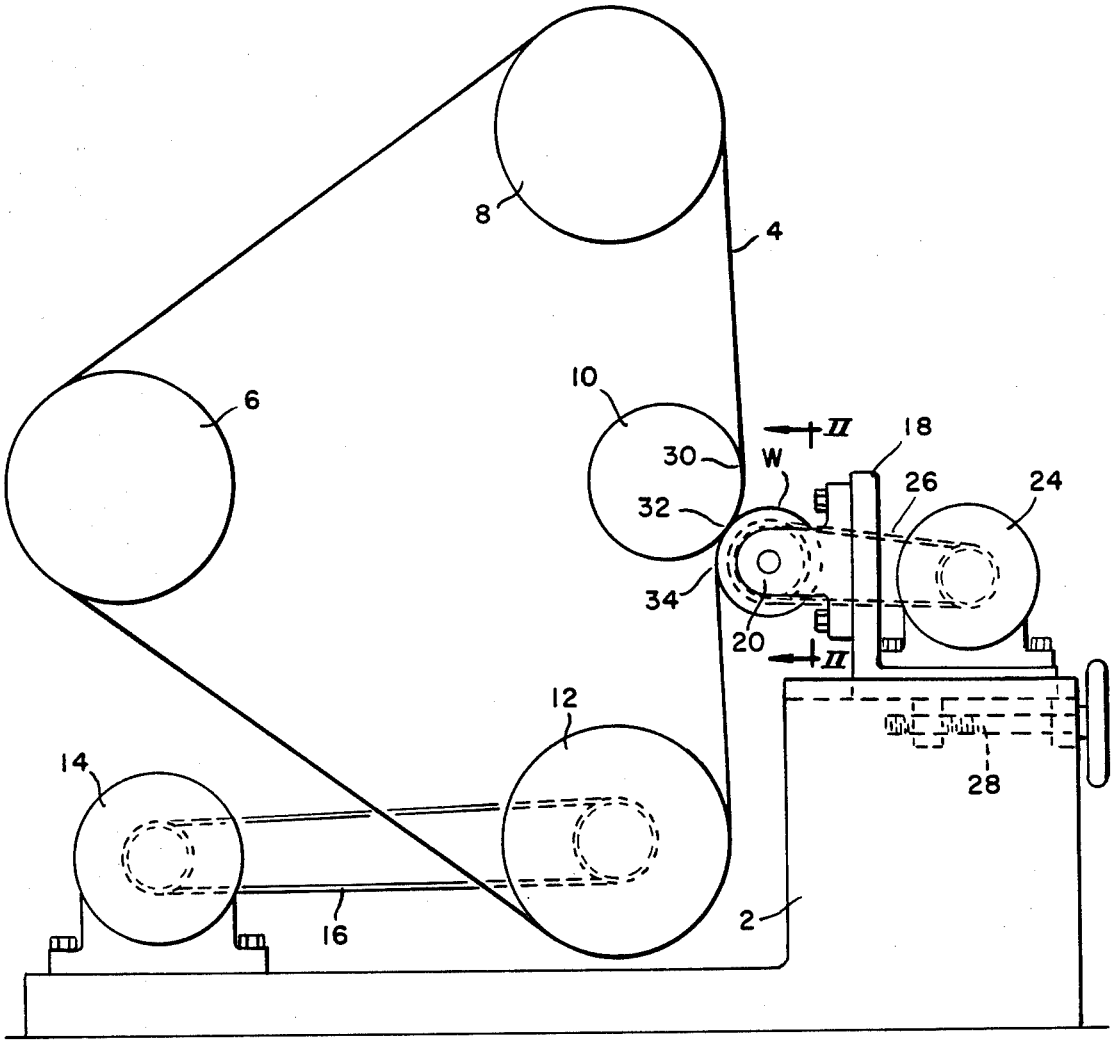
FIG. 1 is a skematic elevation of the apparatus of our invention.
Figure 2:
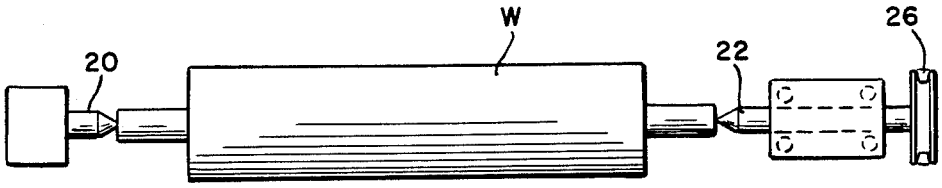
FIG. 2 is a view taken on line II—II of FIG. 1.

Referring more particularly to the drawings reference numeral 2 indicates the frame or housing of the grinder. An abrasive belt 4, in the form of a ring, is passed around idler rolls 6 and 8, pressure roll 10, and drive roll 12 which is driven by motor 14 by means of belt 16. Also mounted on housing 2 is a slidable spindle support 18 for supporting spindles 20 and 22 which carry workpiece W shown in the form of a cylinder. The spindle 22 is rotated by means of a motor 24 through belt 26. The support 18 is fed toward the pressure roll 10 by means of screw and nut feed 28. The parts so far described are conventional except for the specific arrangement of the pressure roll 10, workpiece W and the arrangement of belt 4 therearound. The rolls

6, 8 and 10 are rotated by the belt 4 passing thereover, but they could be driven if desired.

According to our invention the belt 4 passes around roll 10 between tangent points 30 and 32 and around workpiece W between tangent points 32 and 34. Hence point 32 is the pinch point of the belt.

In operation, after the workpiece W is mounted and positioned as shown, motors 14 and 24 are started up and the workpiece fed against the abrasive surface of the belt 4 at the pinch point. Normally the belt 4 will rotate clockwise, but it may also rotate counterclockwise. The operator by means of feed 28 feeds the workpiece W rapidly, thus keeping pressure at the pinch point high. This continues until the surface of the workpiece is as desired. It will be seen that the longitudinal axis of the workpiece is so positioned that its outer periphery is substantially parallel to the transverse surface of the belt at the tangent point on the roll 10. In the above illustration with the cylindrical workpiece, the axis of the workpiece is substantially parallel to the transverse surface of the belt. With a conical or tapered workpiece the axis of the workpiece will be at an angle to this transverse surface.

The roll 10 may be replaced by a stationary platen having a contact surface around or over which the belt passes. However, it is greatly preferred to use a rotating roll. The arc of contact of the belt around the workpiece must be substantial, so that it is sufficient to heat the workpiece relatively uniform. The optimum length of wrap for different types of workpieces is obtained quickly by experiment. The majority of the abrading preferably occurs at the pinch point, but a substantial amount also occurs at the wrap.

It will be understood that the belt and feed arrangement may vary from that shown so that the invention can be used with most or all conventional apparatus with little or no change thereto. The position of rolls 8 and/or 10 may be changed so that the belt 4 will pass only on a tangent to roll 10 without any wrap around roll 10. Also, the belt 4 may be directed around an arc of the workpiece W on both sides of the tangent point 32.

It is only necessary that there be an endless abrasive belt passing over a belt contact surface with the workpiece moving against the belt substantially at a tangent point on the contact surface and around a substantial arc of the workpiece away from the tangent point in either one or both directions for a distance sufficient to heat the workpiece relatively uniform. Wrap greater than sufficient to heat the workpiece uniformly has no beneficial effect and too much wrap can cause problems. The belt 4 may be of sufficient width to span the width of the workpiece. In this case the workpiece is fed inwardly during the grinding until the grinding is finished. The belt 4 may also be of less width than the length of the workpiece. In this case the workpiece is moved inwardly a desired distance and the belt traversed to grind the full width. If necessary the workpiece is then moved further inwardly and another traverse is made. This is repeated as required.

It will be understood that there are many variations in workpiece materials, sizes and surfaces so that changes in parameters must be made. Under prior art practices the operator makes these changes. The same is true of the present invention. However, there are additional guide lines which should be followed. The surface speed of the workpiece should be increased and it is preferred that the speed be at least double that used in conventional grinding operations. Additional increases in speed are not detrimental and may even be beneficial as long as they do not result in excessive vibration. The speed of the belt is generally similar to the speed in other belt grinding of similar workpieces. The amount of wrap sufficient to heat the workpiece relatively uniform is readily obtainable by experiment. In general the larger the diameter the greater the wrap must be. We have found that for most, if not all, workpieces the minimum wrap must be $\frac{1}{8}$ inch.

In "plunge" grinding (that in which the belt contacts the full length of the workpiece) a gradual workpiece feed of 0.015 inch per minute has been successful on one particular workpiece, but the feed may vary a lot. In traverse grinding individual feeds of 0.002 to 0.004 inch have been used for each pass with success, but here too variations in feed may be made. In traverse grinding of one particular hollow cylindrical workpiece having a diameter of approximately 3 inches and a length of 13 inches only one traverse taking approximately one minute was made with splendid results. The workpiece had end radial variations from that desired of 0.001 inch and 0.0025 inch and a center variation of 0.0025 inch. After the one pass there was a uniform variation of 0.0005 inch, the approximate quality limit of the work rotating device used.

While several embodiments have been shown and described it will be apparent that other adaptations and modifications may be made within the scope of the following claims.

We claim:

1. A method of grinding a non-uniform workpiece to substantially remove its non-uniformity by means of an endless abrasive belt which comprises rotating the workpiece about a longitudinal axis, passing the inside of said belt in contact with a belt contact surface at a tangent point, moving said workpiece against the outside of said belt substantially at said tangent point on said contact surface and holding it in positive contact with said belt, wrapping said belt around an arc of said workpiece in firm contact therewith a distance sufficient to heat the workpiece substantially uniformly, and moving said belt continuously to grind said substantially uniformly heated workpiece.

2. A method according to claim 1 in which the workpiece has an axial opening therein.

3. A method according to claim 2 in which the workpiece is moved inwardly toward said belt contact surface during the grinding operation until it is ground to the desired tolerance.

4. A method according to claim 1 in which the belt contact surface for the inside of the belt is a rotating roll.

5. A method according to claim 4 in which the belt wrap around said workpiece is after it leaves the rotating roll.

6. A method according to claim 4 in which the belt wrap around said workpiece is before it leaves the rotating roll.

* * * * *